US005230101A

United States Patent [19]

Hedges et al.

[11] Patent Number: 5,230,101

[45] Date of Patent: Jul. 27, 1993

[54] DUAL VISOR OPERATING MECHANISM

[75] Inventors: George D. Hedges; Francis J. Kuna, both of Carbondale, Pa.

[73] Assignee: Gentex Corporation, Carbondale, Pa.

[21] Appl. No.: 766,754

[22] Filed: Sep. 27, 1991

[51] Int. Cl.[5] ..... A42B 3/22

[52] U.S. Cl. ..... 2/424; 2/6; 2/10; 292/252; 292/204

[58] Field of Search ..... 2/10, 6, 15, 410, 422, 2/424, 9; 292/204, 252; 188/83, 82.3, 82.84

[56] References Cited

U.S. PATENT DOCUMENTS

| | | | |
|---|---|---|---|
| 1,479,117 | 1/1924 | Trimmer | 292/204 |
| 1,742,764 | 1/1930 | Giltsch | 292/204 |
| 1,747,707 | 2/1930 | Grosse | 292/204 |
| 3,405,839 | 10/1968 | Saarem | 292/252 |
| 3,553,984 | 1/1971 | Grumbach | 292/252 |
| 3,636,565 | 1/1972 | Luisada | 2/6 |
| 3,764,172 | 10/1973 | Standke | 292/252 |
| 3,980,327 | 9/1976 | Duran | 292/252 |
| 4,170,792 | 10/1979 | Higgs | 2/6 |
| 4,397,047 | 8/1983 | Nava | 2/424 |
| 4,572,011 | 2/1986 | Mauchlen | 292/252 |
| 4,718,127 | 1/1988 | Rittmann | 2/424 |
| 4,748,696 | 6/1988 | Fohl | 2/424 |
| 4,766,609 | 8/1988 | Lane | 2/424 |
| 4,885,806 | 12/1989 | Heller | 2/424 |
| 4,887,320 | 12/1989 | Long | 2/6 |
| 5,005,221 | 4/1991 | Chen | 2/424 |
| 5,062,162 | 11/1991 | Kamata | 2/424 |

FOREIGN PATENT DOCUMENTS

| | | | |
|---|---|---|---|
| 3639261 | 5/1988 | Fed. Rep. of Germany | 2/15 |
| 2022989 | 12/1979 | United Kingdom | 2/410 |
| 1560723 | 2/1980 | United Kingdom | 2/424 |
| 8803766 | 6/1988 | World Int. Prop. O. | 2/15 |

*Primary Examiner*—Clifford D. Crowder
*Assistant Examiner*—Diana L. Biefeld
*Attorney, Agent, or Firm*—Shenier & O'Connor

[57] ABSTRACT

A dual visor operating mechanism in which respective locks disposed between inner and outer visor arm hubs and respective right and left arbors normally prevent movement of the visors in response to force applied directly thereto and in which respective inner and outer visor actuators sequentially release their associated brakes and then move the visors therewith. Brakes prevent movement of the visors after release of the associated lock and before the corresponding visor moves with the actuator.

6 Claims, 2 Drawing Sheets

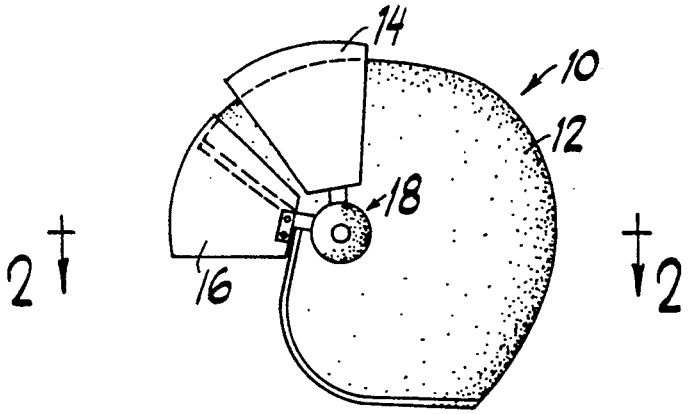
FIG. 1
FIG. 2
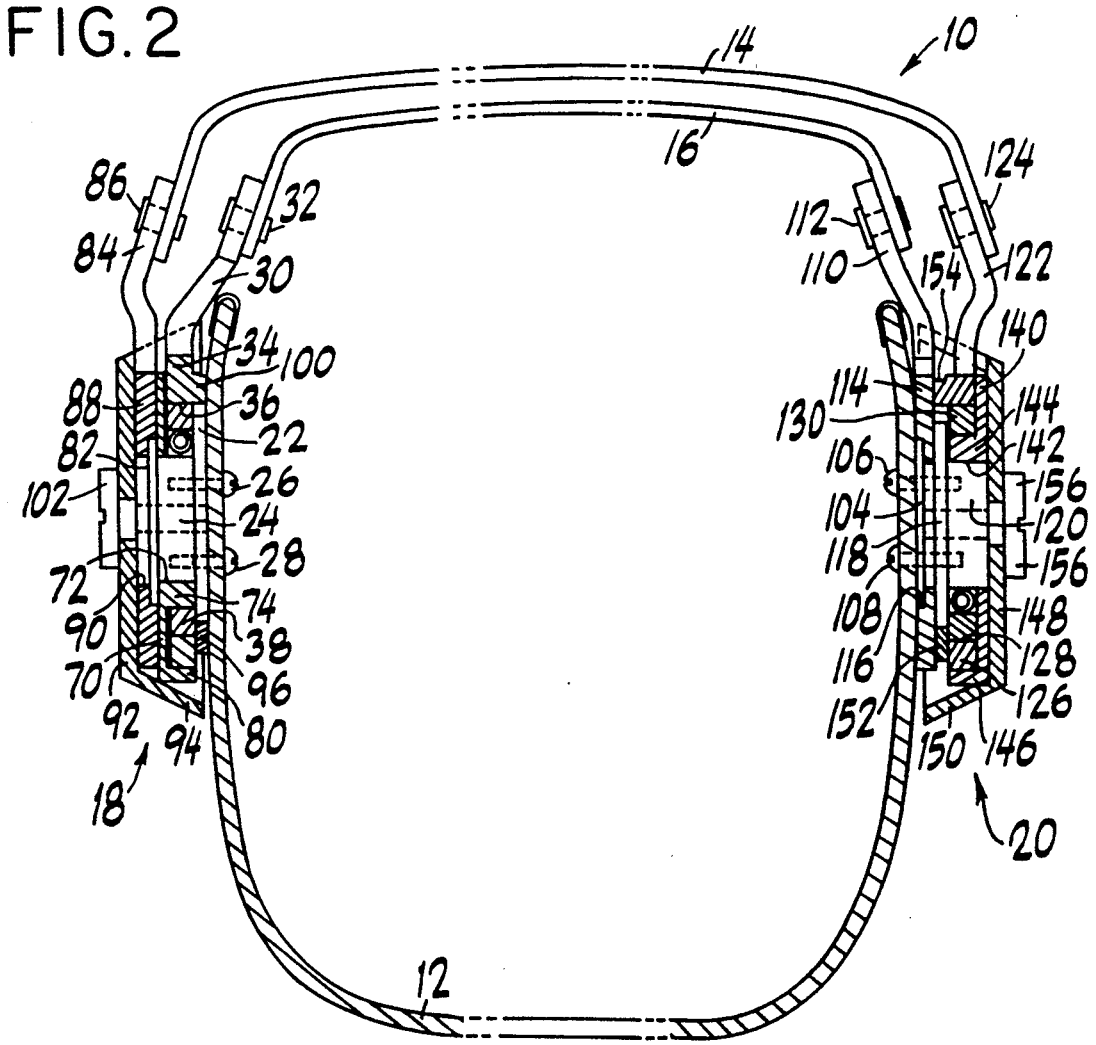

DUAL VISOR OPERATING MECHANISM

FIELD OF THE INVENTION

The invention is in the field of operating mechanisms for dual visors carried by protective helmets or the like and relates to a dual visor operating assembly which overcomes the defects of dual visor operating assemblies of the prior art.

BACKGROUND OF THE INVENTION

There are known in the prior art protective helmets which are provided with inner and outer visors, each of which is mounted on the helmet for movement between an inoperative or retracted position and an operative position at which it is disposed in front of the eyes of the person wearing the helmet. Customarily, one of the visors is tinted and the other visor is clear.

Various mechanisms are known in the prior art for selectively moving the inner and outer visors between the retracted position and the operative position. In one form of such a device, the helmet carries a housing which receives the visors in their inoperative position. The mechanism for moving the visors between the inner and outer positions incorporates an element which moves along a slot which extends in a fore and aft direction in the visor housing. An example of a mechanism of this sort is shown in Long et al U.S. Pat. No. 4,887,320. In some instances it may not be desirable to provide the helmet with a visor housing. Further, the particular operating mechanism including the member movable along the housing slot may be relatively inconvenient to use or too cumbersome.

Other forms of dual visor operating assemblies incorporate tracks extending in a fore and aft direction on the helmet shell and along which an operating member may slide in the course of moving a visor between its operative and inoperative positions. An example of such an arrangement is shown in Aileo U.S. Pat. No. 3,748,657. Again, for one reason or another, an operating mechanism of this type may not be desirable.

Still another mechanism for moving a visor between its operative and inoperative positions is shown in Luisada et al U.S. Pat. No. 3,636,565. That patent shows respective normally locked knobs on the sides of the helmet which can be released and individually rotated to move the respective inner and outer visors between their operative and inoperative positions. The mechanisms for achieving this result, however, are relatively complicated and expensive. In addition, they have a relatively high profile which in many instances is objectionable.

Still another form of dual visor operating mechanism is shown in our application Ser. No. 07/588,686, filed Sep. 26, 1990. In the arrangement shown therein, the respective inner and outer visors are pivotally supported for movement between their operative and inoperative positions by means of arbors located at the respective sides of the helmet shell. Releasable means is provided for frictionally clamping the visors to the arbors. This arrangement has the advantage of a low profile and infinite adjustment. A limitation, however, is the reliance on friction alone to hold the visor in its adjusted position. Stated otherwise, the arrangement does not provide a positive lock.

Still another form of dual visor operating mechanism is shown in Higgs U.S. Pat. No. 4,170,792. In the arrangement shown in the Higgs patent a clutch output member carried by the visor is rotatably supported on a cylindrical boss secured to the helmet shell. A cutout in the clutch output member receives a pair of balls which are urged by respective springs toward the central reduced diameter portion of the cutout to wedge the balls between the boss and the clutch output member. Any force exerted directly on the visor in an effort to move it up or down is resisted by the wedging action of the balls. A knob rotatably supported on the boss carries a clutch release element disposed between the balls and adapted to be moved into engagement with one or the other of the balls to move it against the action of its spring to a relatively larger diameter portion of the cutout to release the visor for movement with the knob to an adjusted position in which it is locked by the balls.

While the Higgs patent provides infinite adjustment of the position of the visor and a relatively positive locking action, it incorporates a number of defects. First, the operation of the device is not as smooth as is desired. More particularly, if the visor is in the up position and the person wearing the helmet actuates the knob to move the visor down, after the ball which had been holding the visor in the up position is moved to the release position, the weight of the visor itself causes it to get ahead of the wearer's movement of the knob so that the visor moves down in a number of steps. That is to say, in the course of the wearer's movement of the knob from the up position to the desired down position, the visor falls down a short distance, is locked again, is unlocked, and moves down another short distance through gravity until it is again stopped. This operation continues until the desired adjusted position is reached.

SUMMARY OF THE INVENTION

One object of our invention is to provide a dual visor actuating assembly which overcomes the defects of dual visor operating assemblies of the prior art.

Another object of our invention is to provide a dual visor operating mechanism which permits of infinite adjustment of the position of the visor between operative and inoperative positions.

Yet another object of our invention is to provide a dual visor operating mechanism which affords infinite adjustment of visor position while at the same time affording a positive lock of the visor in its adjusted position.

A still further object of our invention is to provide a dual visor operating mechanism which is smooth in its operation.

Other and further objects of our invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views.

FIG. 1 is a side elevation of a helmet provided with our improved dual visor operating mechanism.

FIG. 2 is a sectional view of the helmet shown in FIG. 1 taken along the line 2—2 of FIG. 1 and drawn on an enlarged scale.

DESCRIPTION OF THE PREFERRED EMBODIMENT

Figure 4:
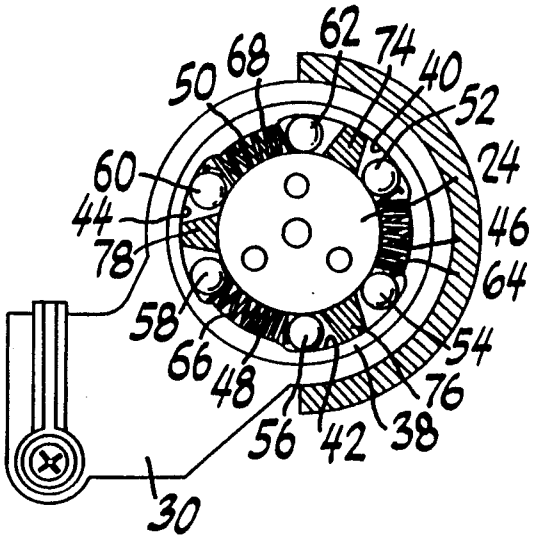
FIG. 4 is a sectional view of our improved visor operating mechanism for one of the visors of the helmet shown in FIG. 1.

Referring now to the drawings, our improved dual visor operating mechanism to be described more fully hereinbelow, may be applied to a helmet indicated generally by the reference character 10 made up of a shell 12 with which there are associated an outer visor 14 and an inner visor 16. We provide respective left-hand and right-hand operating mechanisms indicated generally by the respective reference characters 18 and 20 for the inner and outer visors 16 and 14.

In the embodiment of our assembly illustrated in the drawings, the left-hand assembly 18 is adapted to operate the inner visor 16 and to permit the outer visor 14 to rotate relative thereto. The assembly 18 includes a left-hand base 22 formed with a reduced diameter portion 24 and secured to the shell 12 by any suitable means such for example as by screws 26 and 28. It will be appreciated that base 22 on its reduced diameter portion 24 constitute an arbor.

We secure the left-hand inner visor arm 30 to the left-hand side of the inner visor 16 by any suitable means, such for example as by rivets 32. The arm 30 has a hub 34 formed with an opening 36 which receives an outer clutch ring 38 of our assembly. The outer ring 38 is secured to the hub 34 for rotation therewith. It is to be understood that while we have shown the outer ring 38 and the arm 30 as being separate parts, they can be formed as a single integral element.

Referring now to FIG. 4, we form the outer ring 38 with three variable diameter 40, 42 and 44 separated by constant diameter portions 46, 48 and 50. As will be explained more fully hereinbelow, the end regions of each of the portions 40, 42 and 44 are of relatively larger diameter than are the central areas of these portions. Moreover, the diameter of the constant diameter portions 46, 48 and 50, is less than the diameter of the outer areas of the portions 40, 42 and 44 so as to form shoulders between the ends of the constant diameter portions and the adjacent ends of the variable diameter portions.

Our operating mechanism 18 includes respective pairs of rolling elements such as rollers or balls 52 and 54, 56 and 58, and 60 and 62, the respective balls of each pair of which are located in adjacent variable diameter portions of the ring 38. Specifically, balls 62 and 52 are located in portion 40. Balls 54 and 56 are located in portion 42 and balls 58 and 60 are located in portion 44.

Respective compression springs, 64, 66 and 68 located in the constant diameter portions 46, 48 and 50 are disposed between the respective balls of the pairs of balls 52 and 54, 56 and 58 and 60 and 62. Each spring urges the balls of its associated pair away from each other and into engagement with the reduced diameter region of the variable diameter portion in which the ball is disposed.

Figure 3:
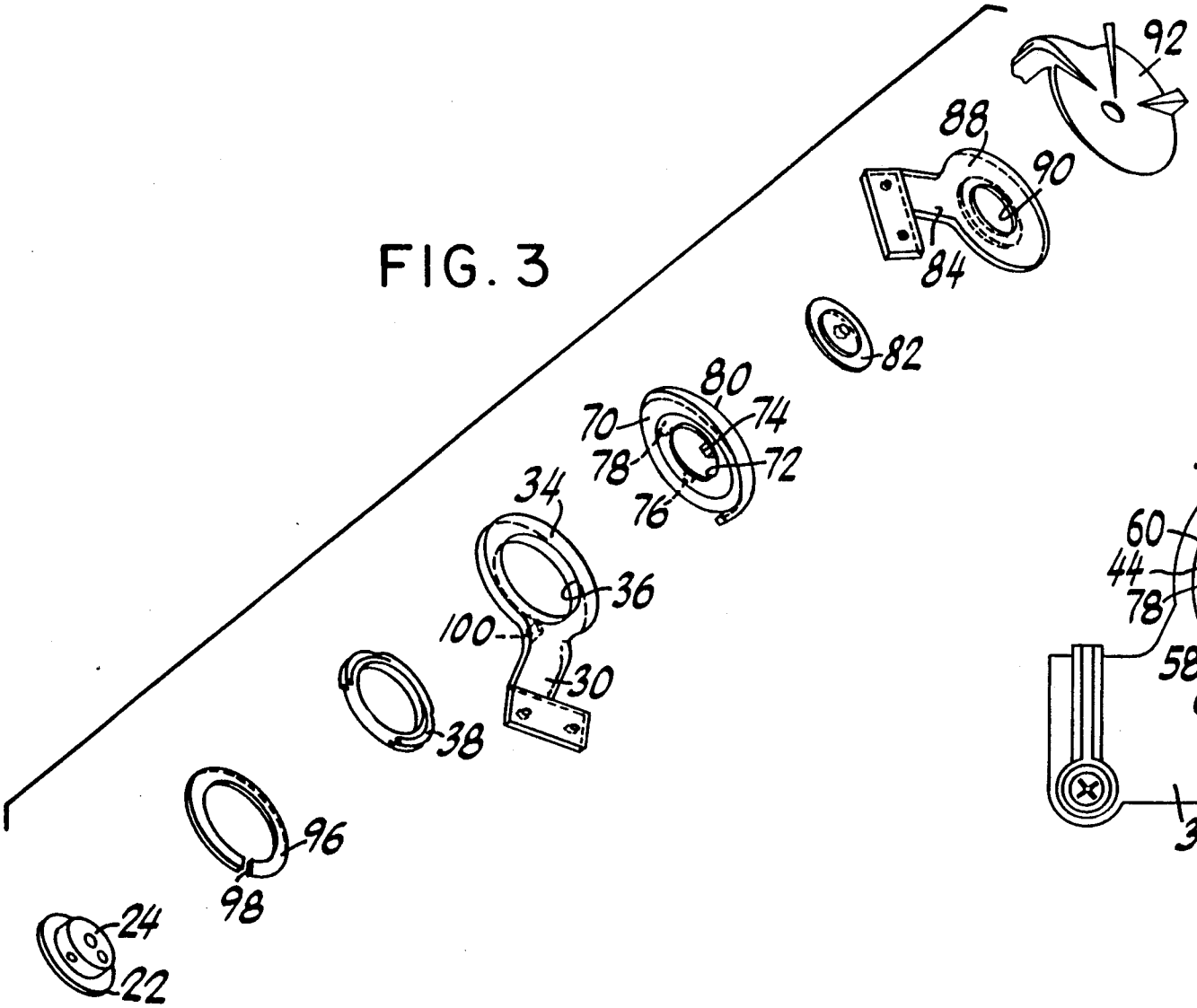
FIG. 3 is an exploded view of our improved dual visor operating mechanism for operating one of the visors of the helmet shown in FIG. 1.

Referring to FIGS. 2 to 4, the mechanism 18 includes an actuator 70 having a central opening 72 which receives the reduced diameter part 24 of the base 22. We provide the actuator 70 with three protuberances or bosses 74, 76 and 78 extending into the space between the outer race 38 and the reduced diameter portion 24. The bosses 74, 76 and 78 are disposed respectively between the balls of the pairs of balls 62 and 52, 54 and 56 and 58 and 60.

An outer arm base 82 is disposed in an opening 90 formed in a hub 88 of the left-hand outer visor support arm 84. Any suitable means, such for example as screws or nuts or rivets 86, secure the arm 84 to the outer visor 14.

A knob 92 forming part of the assembly 18 has a partial peripheral flange 94 which extends downwardly and into operative engagement with the actuator 70 so that when the knob is turned the actuator will move.

For a reason to be described more fully hereinbelow, we dispose a drag ring or braking element 96 around the base 22. We form the drag ring 96 with a gap 98 which receives a tang 100 formed on the hub 34 of the inner visor arm 30. It is to be understood that the arrangement of parts is such that the drag ring 96 exerts a frictional force creating a braking action which prevents the arm 30 from rotating freely relative to hub portion 24. It will be seen that the portions of the drag ring or braking element 96 at the sides of gap 98 and the tang 100 formed on the hub 34 of the visor arm 30 carried by the inner visor 16 constitute interengageable means on the drag ring or braking element 96 and on visor 16.

A screw 102 secures the parts of the mechanism 18 in operative relationship to the reduced portion 24 and the base 22.

The mechanism 20 includes a right-hand inner visor arm base 104 secured at the proper location on the shell 12 by means of screws 106 and 108. Base 104 is received in an opening 116 in the hub 114 of the right-hand inner visor arm 110. We employ any suitable means, such for example as rivets 112, for securing the inner visor 16 to the arm 110. As will be apparent from the description hereinafter, arm 110 rotates relative to the base 104 when the mechanism 18 is actuated.

Screws 106 and 108 also secure an outer arm base 118 having a reduced diameter portion 120 to the shell 12. Base 118 with its reduced diameter portion 120 constitute arbor. We secure the outer visor 14 to a right-hand outer visor arm 122 by any suitable means, such for example as screws and nuts or rivets 124. Arm 122 has a hub 126 formed with an opening 128 which receives the outer ring 3 of the mechanism 20. It will readily be appreciated that if desired, we may form the outer ring 130 integrally with the hub 126 of the arm 122. Outer ring 130 is formed with raceway portions which are the same as those described hereinabove in connection with outer race 38. In addition, the space between the outer ring 130 and the reduced diameter portion 120 of base 118 receives sets of rollers or balls and springs in the same manner as does the space between the outer ring 38 and the reduced diameter portion 24.

Mechanism 20 includes an actuator 140 having an opening 142 which receives the reduced diameter portion 120. We form the actuator 140 with three projections or bosses, one boss 144 of which is shown in FIG. 2. These projections or bosses are disposed between the pairs of balls associated with mechanism 20 in the same manner as are the bosses 74, 76 and 78 of the mechanism 18. We form the actuator 140 with a skirt 146 extending partway around the actuator.

A knob 148 forming part of the assembly 20 has a partial peripheral flange 15 which extends downwardly and into operative engagement with the skirt 146 so that when the knob 148 is turned, the actuator 140 will move.

The mechanism 20 includes a drag ring 152 formed with a discontinuity similar to the discontinuity 98 in the drag ring 96. A tang 154 formed on the hub 126 of the arm 122 extends into the opening or discontinuity of the drag ring 152.

A screw 156 threaded into the reduced diameter portion 120 of the base 118 holds the parts of the mechanism 20 in assembled relationship. From the foregoing it will be seen that means mounting the inner visor 16 on the helmet shell 12 is constituted at the left, as viewed in FIG. 2, by arm 30, hub 34, actuator 70 and portion 24 of base 22 and at the right, as viewed in FIG. 2, by arm 110 and base 104. Similarly, means mounting the outer visor 14 on the helmet shell is constituted at the left, as viewed in FIG. 2, by arm 84 and base 82 and at the right by arm 122, hub 144 and portion 120 of base 118.

In operation of our improved dual visor operating mechanism, each of the visors 14 and 16 is held in position by the wedging action of the balls of the respective operating mechanisms 18 and 20. For example, the inner visor 16 is held in position by the action of the pairs of balls 52 and 54, 56 and 58 and 60 and 62. Balls 54, 58 and 62 prevent rotation of the arm 30 on boss 24 in a counter-clockwise direction as viewed in FIG. 4. The other balls 52, 56 and 60 prevent rotation of the arm 30 around the boss 24 in a clockwise direction. It will be seen that the pairs of balls 52 and 54, 56 and 58 and 60 and 62, under the action of springs 64, 66 and 68, cooperate with the shoulders at the ends of constant diameter portions 46, 48 and 50 of ring 38 to provide a releasable lock for holding the visor 16 in the position to which it has been moved. Mechanism 20 provides a similar releasable lock for visor 14.

If it is desired to lower the visor 16, knob 92 is turned in a counterclockwise direction as viewed in FIG. 4, around the boss 24 to cause the actuating elements 74, 76 and 78 to engage balls 52, 56 and 60 and move them into the relatively larger diameter end regions of the portions 40, 42 and 44. As soon as the balls are freed, the visor 16, in the absence of drag ring 96, would be free to move, falling by its own weight. However, owing to the engagement of the tang 100 disposed in the gap 98 of the drag ring 96, the visor is restrained against movement by the gripping action of the drag ring until the balls 54, 58 and 62 have been moved into engagement with the respective shoulders between portions 40, 42 and 44 and the adjacent portions 46, 48 and 50 by rotation with the knob. When this engagement takes place, the visor can be moved smoothly with the knob to its new adjusted position. A similar action takes place when the knob 92 is moved in a clockwise direction around the boss 24 to raise the visor 16. Since the operation of the mechanism 20 is substantially the same as that of the mechanism 18, no detailed description of the former will be given.

It will be seen that we have accomplished the objects of our invention. We have provided a dual visor operating mechanism which overcomes the defects of dual visor operating mechanisms of the prior art. Our mechanism affords infinite adjustment of the visor between its raised and lowered positions. At the same time, it provides a positive lock of the visor in its adjusted position. Our mechanism ensures a smooth movement of both the inner and outer visors to any position between their operative and inoperative positions.

It will be understood that certain features and subcombinations are of utility and may be employed without reference to other features and subcombinations. This is contemplated by and is within the scope of our claims. It is further obvious that various changes may be made in details within the range of our claims without departing from the spirit of our invention. It is, therefore, to be understood that our invention is not to be limited to the specific details shown and described.

Having thus described our invention, what we claim is:

1. A helmet and visor assembly including in combination a helmet shell, a visor, means mounting said visor on said helmet shell for movement between operative and inoperative positions, a releasable lock for normally locking said visor against movement in response to a force applied directly thereto, a braking element, interengageable means on said visor and on said braking element for restraining said visor against movement following the release of said lock and an actuator for sequentially releasing said lock and moving said visor between said positions against the action of said braking element.

2. An assembly as in claim 1 in which said mounting means comprises an arbor on said shell and an arm secured to said visor and rotatable around said arbor, said braking element is a drag ring on said arbor and said interengageable means is on said arm and said drag ring.

3. An assembly as in claim 1 in which said mounting means comprises an arbor on said shell, an arm secured to said visor and a hub on said arm surrounding said arbor, said braking element is a drag ring carried by said hub, said interengageable means comprising a notch in said drag ring and a tang on said hub disposed in said notch.

4. A helmet and visor assembly including in combination a helmet shell, an inner visor, an outer visor, means mounting each of said visors on said helmet shell for movement between an operative and an inoperative position, a first releasable lock normally locking said inner visor against movement in response to force applied directly thereto, a first braking element, first interengageable means on said first braking element and on said inner visor for restraining said inner visor against movement following the release of said first lock, a first actuator for sequentially releasing said first lock and moving said inner visor between said positions against the action of said first braking element, a second releasable lock normally locking said outer visor against movement in response to force applied directly thereto, a second braking element and interengageable means on said second braking element and on said outer visor for restraining said outer visor against movement following the release of said second lock and a second actuator for sequentially releasing said second lock and moving said outer visor between said positions against the action of said second braking element.

5. An assembly as in claim 4 in which said mounting means comprises right and left arbors carried by the shell and respective right and left inner and outer visor arms carried by said arbors, said first lock being disposed between one of said inner visor arms and one of said arbors, said second lock being disposed between one of said outer visor arms and the other one of said arbors, said first braking element is a first drag ring on said one arbor and interengageable means on said one inner visor arm and said first drag ring, said second braking element is a second drag ring on said other arbor and interengageable means on said one outer visor arm and said second drag ring.

6. An assembly as in claim 4 in which said mounting means comprises right and left arbors carried by said shell and respective right and left inner and outer visor arms having hubs carried by said arbors, said first lock being disposed between one of said inner visor arm hubs and one of said arbors, said second locking being disposed between one of said outer visor arms and the other one of said arbors, said first braking element is a first drag ring carried by said one arbor, said first drag ring having a notch therein and a tang on said one inner visor arm hub disposed in said first drag ring notch, said second braking element is a second drag ring carried by said other arbor, said second drag ring having a notch therein and a tang on said one outer ring visor disposed in said second drag ring notch.

* * * * *

UNITED STATES PATENT AND TRADEMARK OFFICE

CERTIFICATE OF CORRECTION

PATENT NO. :5,230,101

DATED :July 27, 1993

INVENTOR(S) :George D. Hedges and Francis J. Kuna

It is certified that error appears in the above-indentified patent and that said Letters Patent is hereby corrected as shown below:

Column 7, line 2, "locking" should read --lock --.

Column 8, line 4, delete "ring" insert --arm --.
after "visor"

Signed and Sealed this

Twelfth Day of April, 1994

Bruce Lehman

*Attest:*

BRUCE LEHMAN

*Commissioner of Patents and Trademarks*

*Attesting Officer*